US006513208B1

(12) United States Patent
Sack et al.

(10) Patent No.: US 6,513,208 B1
(45) Date of Patent: Feb. 4, 2003

(54) TWO TONGUE BUCKLE MECHANISM WITH FIXED LATCH

(75) Inventors: James A. Sack, Elverson; Arthur L. Gehr, East Earl, both of PA (US)

(73) Assignee: Wonderland Nursery Goods Co., Ltd., Taipei (TW)

( * ) Notice: Subject to any disclaimer, the term of this patent is extended or adjusted under 35 U.S.C. 154(b) by 3 days.

(21) Appl. No.: 09/657,186

(22) Filed: Sep. 7, 2000

Related U.S. Application Data

(60) Provisional application No. 60/152,361, filed on Sep. 7, 1999, and provisional application No. 60/152,360, filed on Sep. 7, 1999.

(51) Int. Cl.[7] ..... A44B 11/00

(52) U.S. Cl. ..... 24/632; 24/631; 24/633; 24/642

(58) Field of Search ..... 24/631, 632, 633, 24/640, 653, 656, 642, 664; 280/801.1, 802

(56) References Cited

U.S. PATENT DOCUMENTS

| | | | | |
|---|---|---|---|---|
| 3,523,342 A | * | 8/1970 | Spires | 24/632 |
| 4,916,780 A | | 4/1990 | Ballet | |
| 5,075,937 A | * | 12/1991 | Schneider et al. | 24/637 |
| 5,086,548 A | * | 2/1992 | Tanaka et al. | 24/579.11 |
| 5,220,713 A | * | 6/1993 | Lane et al. | 24/628 |
| 5,283,933 A | * | 2/1994 | Wiseman et al. | 24/579.11 |
| 5,584,107 A | | 12/1996 | Koyanagi et al. | |
| 5,588,189 A | * | 12/1996 | Gorman et al. | 24/632 |
| 5,606,783 A | * | 3/1997 | Gillis et al. | 24/628 |
| 5,813,097 A | * | 9/1998 | Woellert et al. | 24/587.12 |

FOREIGN PATENT DOCUMENTS

| | | |
|---|---|---|
| DE | 82 30 071 | 9/1983 |
| EP | 0 252 488 | 1/1988 |
| EP | 0 587 345 | 3/1994 |

* cited by examiner

*Primary Examiner*—Anthony Knight
*Assistant Examiner*—Andre' L. Jackson
(74) *Attorney, Agent, or Firm*—Hogan & Hartson LLP; Matthew T. Bailey, Esq

(57) ABSTRACT

A buckle assembly configured to receive a tongue and selectively engaging the tongue with a fixed latch. The buckle assembly includes a release button, a frame and an urging member. The release button receives the tongues and also slidably retains two ejectors. The frame has two fixed lathes that engage the latch receiving slots on the tongues when the tongues are at least partially inserted into the release button. In one embodiment, insertion of the tongues into the release button causes the displacement of two ejectors such that the urging member is able to urge the release button into a closed configuration in which the release button is flush with the frame. When the release button is urged into the closed configuration, the latch receiving slots are engaged by the fixed latches.

21 Claims, 6 Drawing Sheets

TWO TONGUE BUCKLE MECHANISM WITH FIXED LATCH

CROSS REFERENCE TO RELATED APPLICATIONS

This present application claims benefit of U.S. Provisional Application No. 60/152,361 for TWO TONGUE BUCKLE MECHANISM WITH FIXED LATCH, filed Sep. 7, 1999, U.S. Provisional Application No. 60/152,360 for ALL PLASTIC BUCKLE WITH FIXED LATCH, filed Sep. 7, 1999; and U.S. Non-Provisional application Ser. No. 09/544,203 for ASSEMBLY OF A BUCKLE MECHANISM AND A BLADE AND A METHOD OF SECURING AND RELEASING THE BLADE TO THE BUCKLE MECHANISM, filed Apr. 7, 2000, which are hereby incorporated by reference.

BACKGROUND OF THE INVENTION

1. Field of the Invention

The present invention relates to a buckle, and more particularly to a buckle with a fixed latch and adapted to receive one or two tongues which may be used with a multi-point restraint system.

2. Discussion of the Related Art

A number of conventional buckle designs are known in the prior art. Such designs generally suffer from problems and deficiencies relating to operability and reliability. Also, such conventional buckles are often expensive and difficult to manufacture and assemble.

SUMMARY OF THE INVENTION

Accordingly, the present invention is directed to a buckle assembly that substantially obviates one or more of the problems due to limitations and disadvantages of the related art.

An object of the present invention is the provision of a buckle assembly that is stronger, more reliable and more economical than buckles of the related art.

Another object of the present invention is the provision of a buckle assembly configured to receive a tongue and selectively engaging the tongue with a fixed latch.

Another object of the present invention is the provision of a buckle assembly configured to selectively disengage the tongue from the fixed latch and at least partially eject the tongue.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. In one embodiment, a buckle assembly includes a release button, two ejectors, a frame and an urging member. The release button has two buckle insertion openings configured to receive two tongues, which each have latch receiving slots on them. Additionally, the release button includes two ejector voids that slidably retain two ejectors. The frame includes two latches that selectively engage the two tongues via the latch receiving slots. In one embodiment, insertion of both tongues into the release button results in a translation of the ejector such that the urging member is able to urge the release button into a closed configuration flush with the frame, thereby allowing the fixed latches to engage the tongues.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
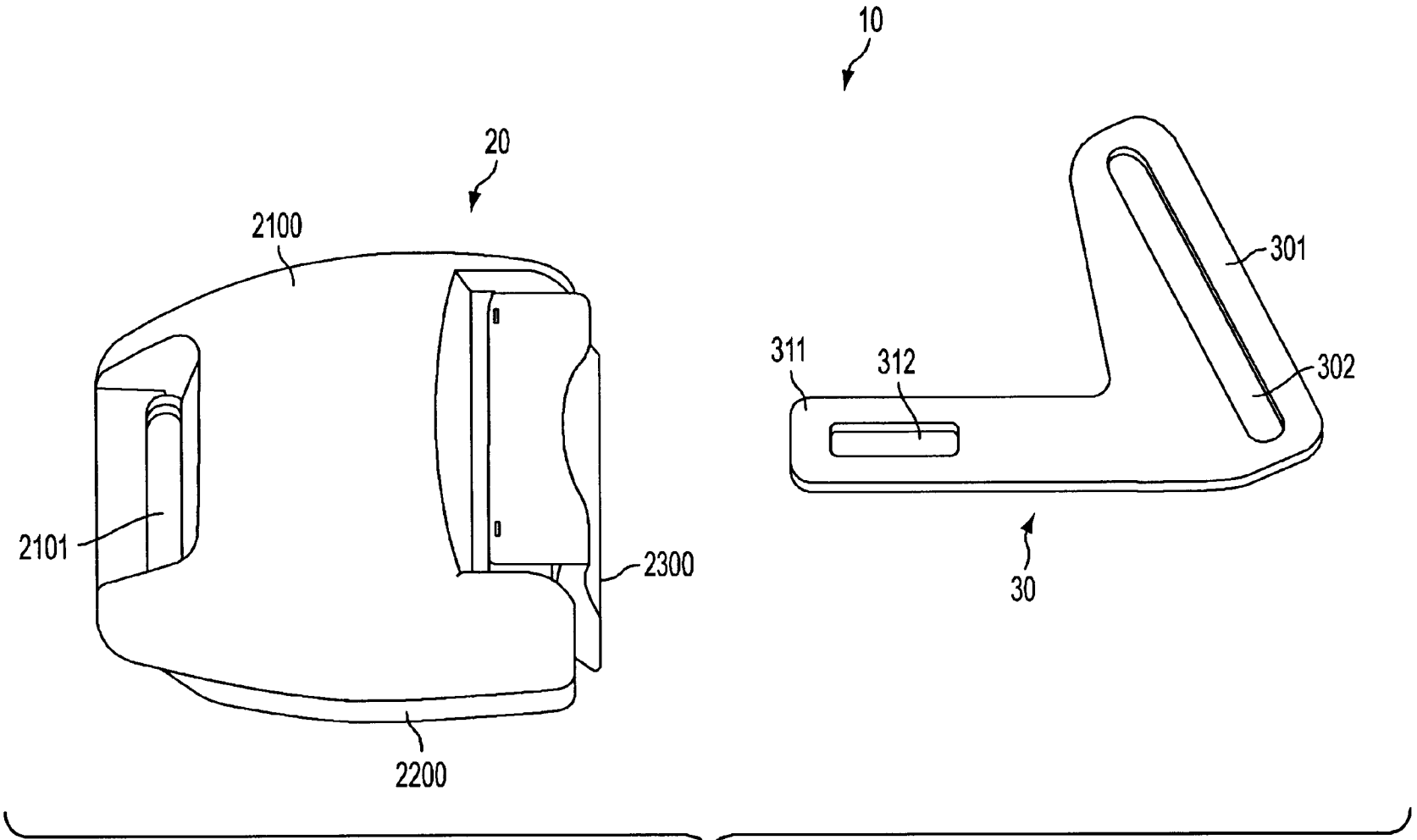
FIG. 1 shows an plan view of the buckle assembly.

Reference will now be made in detail to the preferred embodiment of the present invention, examples of which are illustrated in the drawings.

FIG. 1 shows a plan view of the buckle assembly 10. The buckle assembly 10 preferably includes a buckle body 20. Buckle body 20 comprises a bottom cover 2200, a release member which may be referred to as a release button 2300 and a top belt slot 2101. Buckle assembly 10 also includes two mirror image tongues 30. It will be appreciated that only one tongue 30 is illustrated in FIG. 1. The preferred embodiment shown in FIG. 1 may be used in a conventional multi-point (e.g.,5 point) restraint system.

Each tongue 30 includes a belt end 301 having a belt receiving slot 302, and a latch end 311 having a latch receiving slot 312. The tongue 30 may be constructed from a variety of materials, depending on the use and application of the buckle assembly. These tongue materials may include, for example, plastics or metals. Preferably, the tongues 30 will be constructed of heat-treated stainless steel.

It is known in the prior art to construct a tongue for use with a buckle body using a metal and to subsequently chrome plate the tongue. However, extreme care must be taken in the application of the chrome plating on the tongue. If the chrome plating is too thin, the chrome plating may wear away from the tongue after repeated insertion into and removal from a buckle body. As a result, an underlying metal surface of the tongue is exposed, which is subject to corrosion, and other undesirable effects. Conversely, if the chrome plating is too thick, the chrome. plating may peel away from the underlying metal surface of the tongue. Again, an underlying metal surface of the tongue is exposed, which is subject to corrosion, etc. These disadvantages are obviated by the use of a heat treated stainless steel as a tongue material. Additionally, a conventional prior art tongue is expensive to manufacture, as the manufacturing of the tongue necessarily entails a separate step of chrome plating.

The tongues 30 may or may not be removably united to one another for ease of insertion into the buckle body 20.

The tongues 30 may be fixed together by some structure (not shown) to establish a desired orientation of the tongues to simplify handling and insertion. For example, a removable sleeve (not shown) may be used to removably unite the tongues 30. The removable sleeve may be constructed with one or more slots for each tongue 30. In operation, the tongues 30 may slide into the one or more slots of the removable sleeve, such that the tongues 30 are removably held by the sleeve. The removable sleeve is preferably sized and shaped such that it does not interfere with the insertion of tongues 30 into the buckle body 20. Alternately, the removable sleeve may be permanently attached to either of the tongues 30, such that one tongue 30 is removably held by the sleeve and the other tongue 30 is permanently attached to the removable sleeve. The removable sleeve may be fabricated from, for example, metal or plastic. Furthermore, the two tongues could be permanently attached to one another.

Either or both of the tongues 30 may include a tongue cover (not shown) to achieve a desired appearance, or to facilitate improved operation and belt guidance. The tongue cover may be fabricated from, for example, plastic or metal. The tongue covers may cover any portion of the surface area of either or both tongues 30, up to and including the entire surface area of the tongues 30. The tongue covers may be removably attached to the tongues 30, or the tongue covers may be permanently attached to the tongues 30. The removable sleeve may also be permanently attached to at least one of the tongue covers. Preferably, the tongue covers will cover the surface area of the belt end 302 of the tongues 30, and be permanently attached to the tongues 30. Additionally, preferably one of the tongue covers will be permanently attached to and integral with the removable sleeve. In a preferred embodiment, the tongue covers are configured such that the tongue covers may be removably attached to each other.

Figure 2:
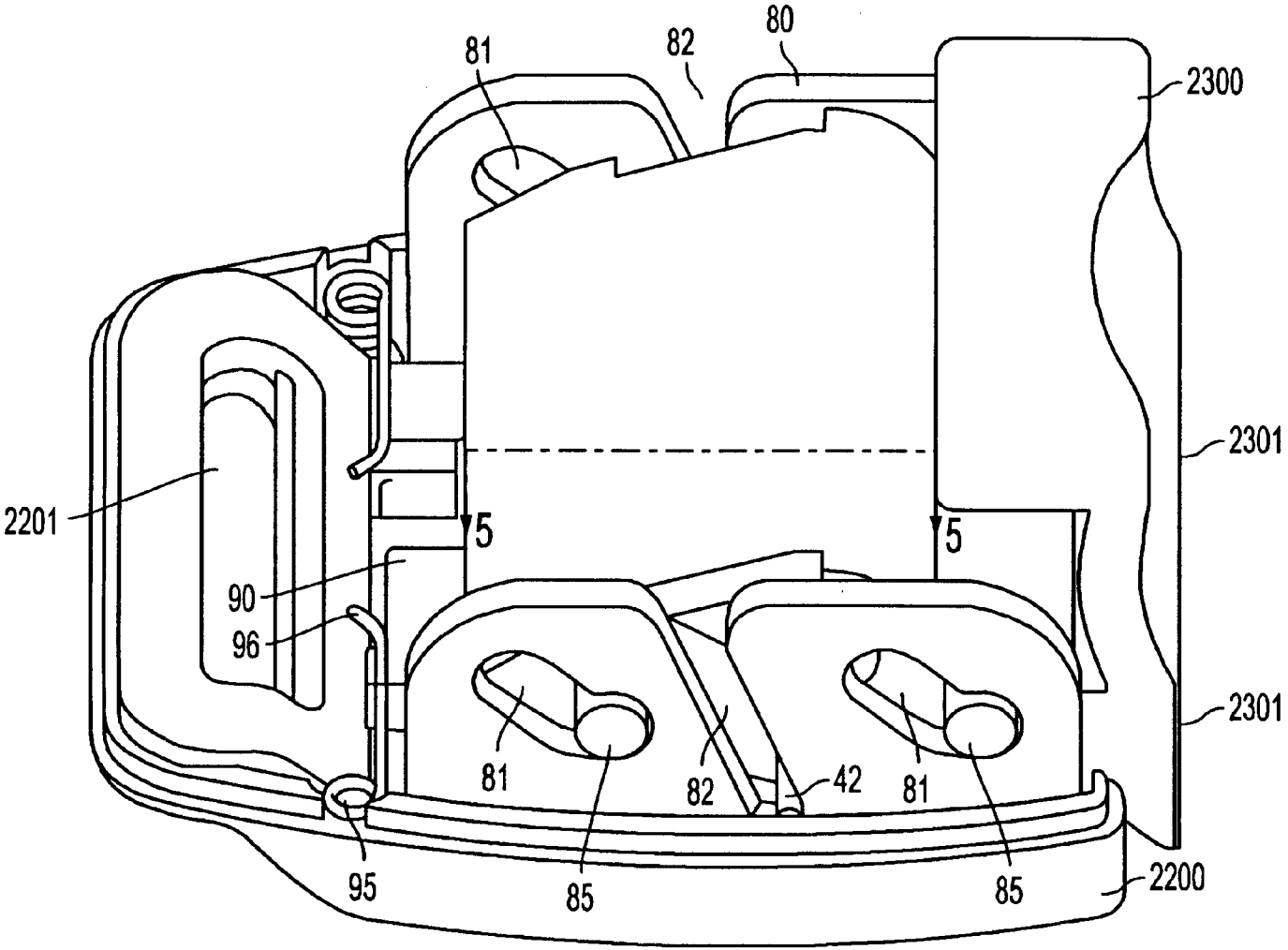
FIG. 2 shows an isometric view of the buckle assembly with the top cover removed.

FIG. 2 shows an isometric view of the buckle assembly 10 with the top cover removed. At a high-level, FIG. 2 shows frame 80 having attachment openings 81, release button 2300, and attachment elements 85 configured to allow release button 2300 to move or translate in a predetermined path in relation to frame 80.

Turning to a more detailed description of FIG. 2, buckle assembly 10 includes bottom cover 2200. Bottom cover 2200 includes bottom belt slot 2201. Residing within bottom cover 2200 is frame 80. FIG. 2 shows four attachment element openings 81 that are formed from the side walls of frame 80.

The release button 2300 resides between two side walls of frame 80. These side walls additionally comprise attachment openings 81 which interface with attachment elements 85. For purposes of this application, when the attachment elements are close to the front of the frame and the base of the frame (i.e., the position shown in FIG. 2), the buckle assembly is in the closed position. When the attachment elements are furthest from the front of the frame and the base of the frame the buckle assembly is in the open position.

FIG. 2 also shows ejector biasing elements 95 including element top arms 96 and element bottom arms 97. The element top arms 96 of the ejector biasing elements 95 are disposed such that the element top arms 96 urge the ejectors 90 into the release button ejector voids 2305. In order to secure the ejector biasing elements 95, the element bottom arms (not shown) are trapped between the bottom cover 2200 and the frame 80. Additionally, the ejector biasing elements 95 are disposed on the biasing posts 2204 (shown in FIG. 3) of the bottom cover. By this arrangement, the ejectors 90 are disposed in the release button 2300, and are urged in a direction which is opposite to the direction of insertion on the tongues 30 (i.e., towards the front of the frame). When the buckle body 20 is fully assembled, the ejector protrusions 91 of the ejectors 90 may be selectively disposed in two stable positions: 1) in the ejector depressions 2203 of the bottom cover 2200 and the frame ejector voids 86 or 2) between frame 80 and release button 2300. The positioning of the ejectors 90 depends on whether the buckle body 20 is in the open or closed position, as described in greater detail in relation to FIGS. 5 and 6. The ejector biasing elements 95 may be fabricated from a variety of materials. These materials may include, but are not limited to, metals, and like materials with similar desired properties. In one embodiment, the ejector biasing elements 95 are fabricated from flat spring steel.

Figure 3:
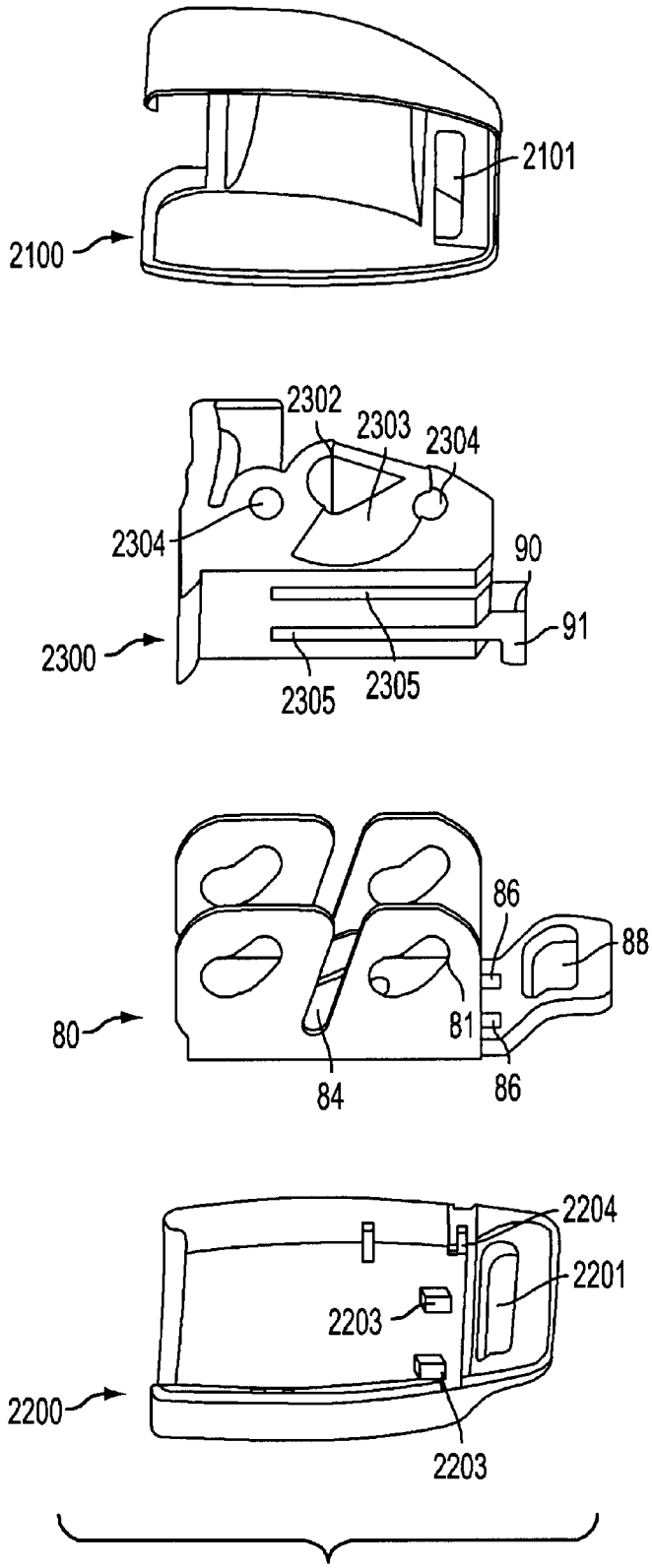
FIG. 3 shows an exploded view of the top cover, release button, frame and bottom cover.

FIG. 3 shows an exploded view of the top cover, release button, frame, and button cover. The top cover 2100 will now be explained in detail. The top cover 2100 includes a top belt slot 2101. Additionally, the top cover includes a variety of ribs, surfaces, and contours to cooperate and mate with the interior components and the bottom cover 2200. The top cover 2100 and the bottom cover 2200 will be aligned to form a buckle body housing. The top cover 2100 may be constructed from a variety of materials including, but not limited to, plastic, metals, or like materials with similar desired properties. Preferably, the top cover 2100 is constructed of high-impact ABS plastic with an ultra-violet inhibitor.

The bottom cover 2200 will now be explained in detail. The bottom cover 2200 includes a bottom belt slot 2201. When the top cover 2100 and the bottom cover 2200 are aligned to form a buckle body housing, the top belt slot 2101 and the bottom belt 2201 are substantially aligned, such that a first belt (not shown) may pass through the top and bottom belt slots 2101 and 2201. The bottom cover 2200 includes a variety of ribs, surfaces, and contours to cooperate and mate with the interior components and the top cover 2100. Notably, the bottom cover 2200 includes ejector depressions 2203 and biasing posts 2204. The bottom cover 2200 may be constructed from a variety of materials. These materials include, but are not limited to, plastic, metals, or like materials with similar desired properties. In one embodiment, the bottom cover 2200 is constructed of high-impact ABS plastic with an ultra-violet inhibitor. Additionally, the bottom cover 2200 may be fabricated from PVC.

The release button 2300 will now be: explained in detail. FIG. 3 shows the bottom of the release button 2300. Buckle insertion openings 2301 of the release button 2300 are sized to receive tongues 30 for buckling within the buckle body 20. The release button 2300 also includes a spring void 2302, opposing spring arm voids 2303 (only one is shown; both are mirror images of one another), and frame attachment opening 2304. The release button 2300 includes release button ejector retaining walls 2309 that define the release button ejector voids 2305. The ejector retaining walls 2309 and the release button ejector voids 2305 are configured to slidably retain the ejectors 90. Specifically, the ejectors 90 may translate only forward or backward (i.e., either toward buckle insertion opening 2301 or away from buckle insertion opening 2301), but cannot translate outside the release button ejector voids 2305. Again, the spring button 2300 is shown with a variety of ribs, surfaces, and contours to cooperate and mate with the top and bottom covers 2100, 2200, and the various other interior components. The release button 2300 may be fabricated from a variety of materials. These materials include, but are not limited to, metals, plastics, or like materials with similar desired properties. Preferably, the release button 2300 will be fabricated from acetal with an ultra-violet inhibitor.

Frame 80 will now be discussed in detail. Frame 80 is located within the interior of the buckle housing created by the top cover 2100 and the bottom cover 2200. As shown in FIG. 3, frame 80 includes attachment openings 81 and spring arm openings 82. Frame 80 also includes fixed latches 84, frame ejector voids 86, a substantially planar surface 87, and a belt slot 83. When in the closed configuration, as described in greater detail below, the fixed latches 84 of the frame 80 are preferably located within the release button ejector voids 2305, preferably within the front end of the release button ejector voids 2305. When the frame 80 is installed in the buckle housing created by the top cover 2100 and the bottom cover 2200, the top, middle, and bottom belt slots 2101, 84, and 2201, respectively, are substantially aligned, such that a belt (not shown) may pass through the belt voids. The frame 80 may be constructed from a variety of materials. These materials include, but are not limited to, metal, plastics, or like materials with similar desired properties. Preferably, the frame 80 will be constructed from SAE 1035 with zinc dichromate finish or a similar material having properties similar to the aforementioned material.

The structure of the ejectors 90 and ejector protrusions 91 will now be explained. FIG. 3 shows only a single ejector 90, but it will be appreciated that a pair of ejectors 90 is used in a preferred embodiment of the buckle housing 20 and that both ejectors 90 are preferably substantially similar to one another. In one embodiment, ejector 90 comprises a planar surface and a planar base extending substantially perpendicular to the planar surface. In a preferred embodiment, ejector 90 is a T-shaped element. Additionally, ejector 90 comprises a protrusion 91 extending from the planar base. This protrusion is preferably sized such that it can fit through ejector voids and rest in ejector depressions. Ejectors 90 may be fabricated from a variety of materials. These materials include, but are not limited to, plastics, metals, or like materials having similar desired properties. Preferably, the ejectors 90 are fabricated from NYLON 66 plastic.

As shown in FIG. 3, the ejector 90 is disposed in an ejector void 2305 of the release button 2300. The ejectors 90 may be installed before the release button 2300 is installed in the frame 80. After the installation of the ejector button 90 in the release button 2300, and the installation of the release button 2300 into the frame 80, ejector biasing elements 95 (shown in FIG. 2) are installed.

Figure 4:
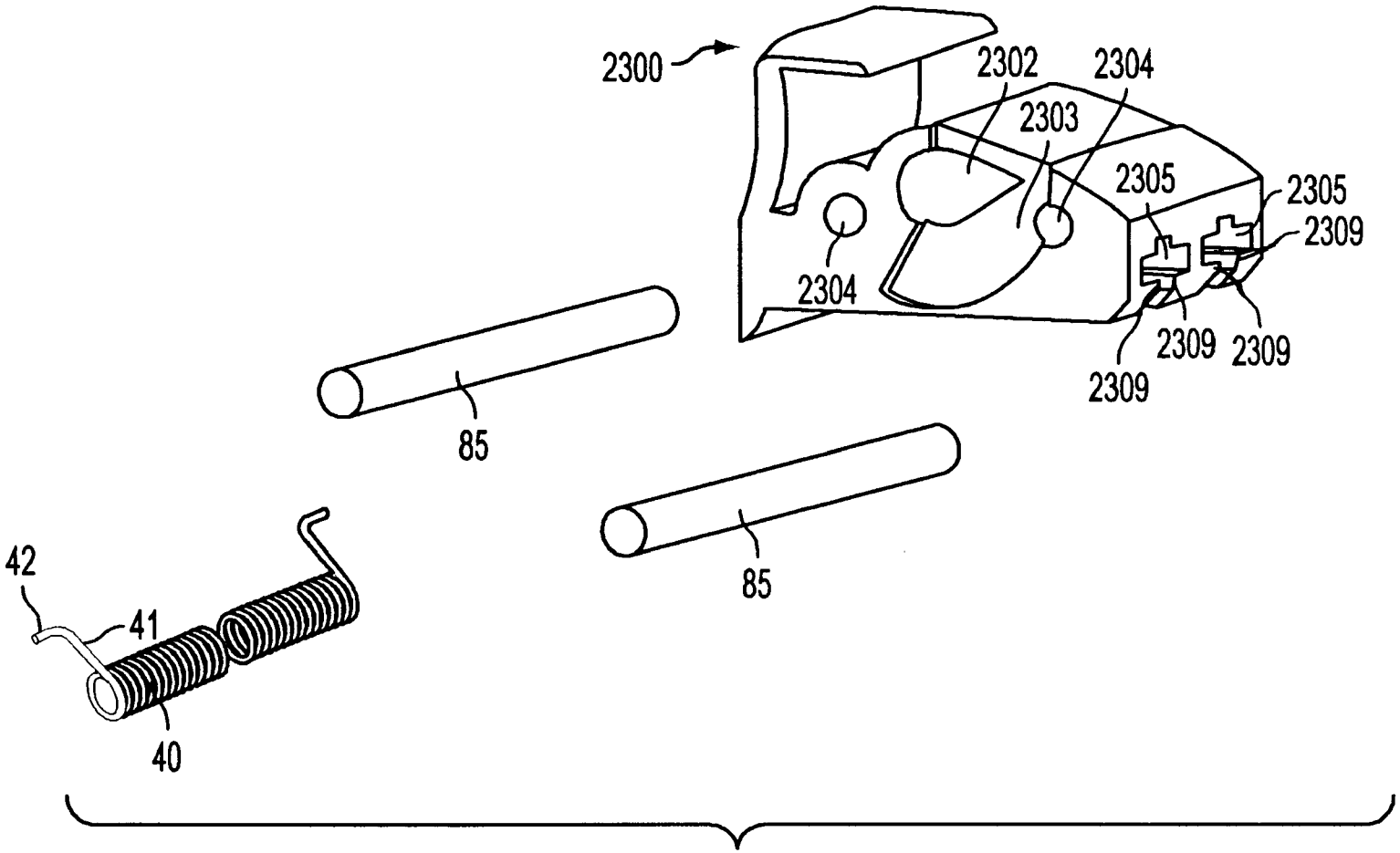
FIG. 4 shows an exploded view of the release button, attachment elements, and one of the springs.

Turning to FIG. 4, the release button 2300 will now be explained in greater detail. Springs 40 reside in the spring voids 2302 of the release button 2300, such that spring arms 41 of springs 40 are located in the spring arm voids 2303 of the release button 2300 (only one spring is shown; the other is a mirror image in a preferred embodiment). Further, springs 40 include spring tabs 42 located on spring arms 41. Preferably, after springs 40 are installed in the spring voids 2302 of the release button 2300, the spring tabs 42 of the springs 40 are inserted into the spring arms openings 82 of the frame 80 as shown in FIG. 2. The springs 40 are oriented such that the release button is biased in a direction in opposition to a direction in which tongues 30 will be installed into the buckle body 20 to form a buckle assembly 10. The springs 40 may be fabricated from a variety of materials, such as metals or like materials with similar desired properties. Preferably, the springs 40 are constructed from music wire.

Attachment elements 85 are installed through the attachment openings 81 of the frame 80 and the frame attachment voids 2304 of the release button 2300. The attachment openings 81 of the frame 80 are preferably sized, located, and oriented such that the release button 2300 remains parallel to the substantially planar surface 87 of the frame 80 (not shown), and may move parallel to and away from the substantially planar surface 87 of the frame 80 along a path defined by attachment openings. In one embodiment, the path of the attachment openings is initially substantially parallel to the planar surface of the frame 80. Accordingly, as the release button 2300 transitions from the closed to the open configuration, the path is initially substantially planar to the surface of the frame 80. The attachment openings 81 may include a variety of shapes, such as kidney, arcuate, L, or angular, to achieve the desired motion of the release button 2300. In a preferred embodiment, two attachment elements 85 (e.g., pins) are inserted into the frame 80 and the release button 2300 after the installation of the springs 40 into the release button 2300 and into the frame 80 (not shown). The attachment elements 85 may be constructed from a variety of materials. These materials include, but are not limited to, plastics, metals, or like materials with similar desired properties. Preferably, the attachment elements 85 are fabricated from music wire. In one embodiment, a zinc dichromate or equivalent material may be used to increase corrosion resistance.

Figure 5A:
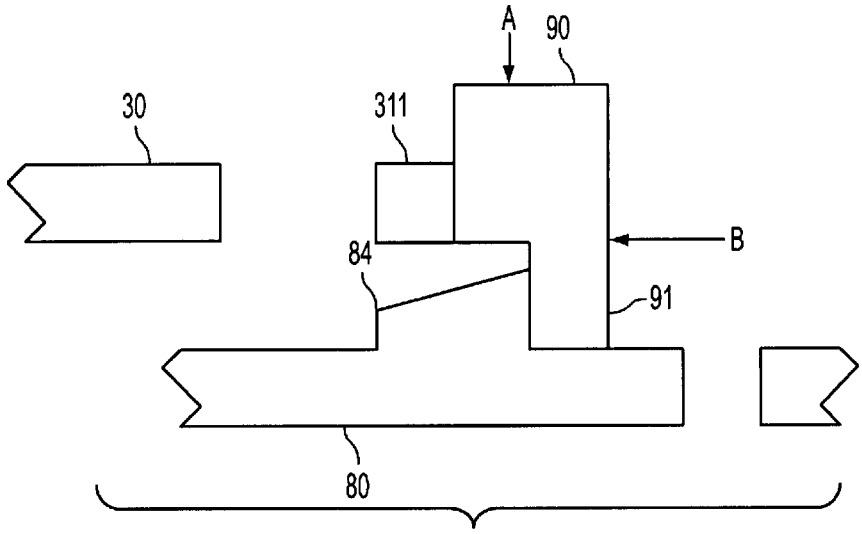
FIGS. 5(*a*) to 5(*c*) show a cross-section taken along 5—5 of FIG. 2 during a buckling process.
Figure 5B:
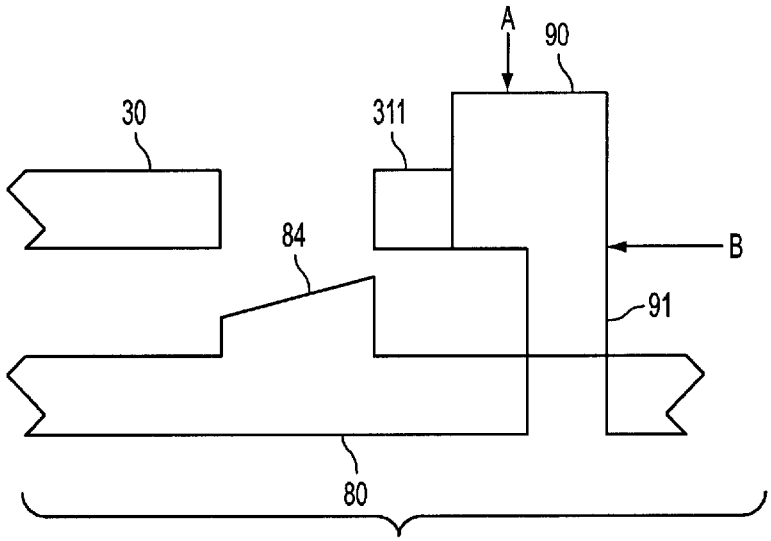
Figure 5C:
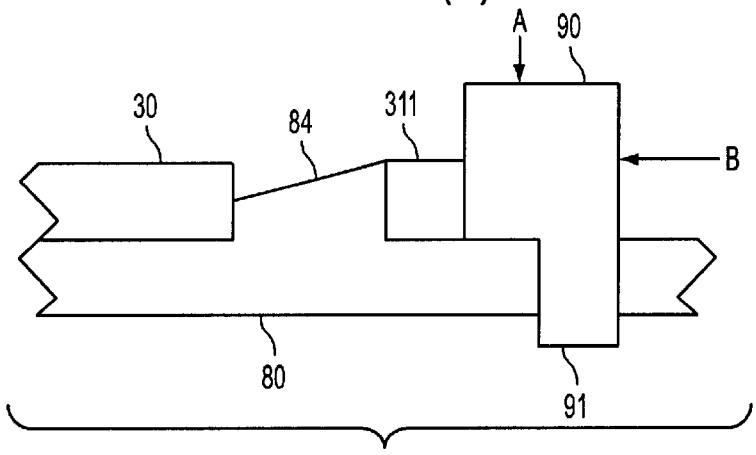

FIGS. 5(*a*) to 5(*c*) show a cross-section taken along 5—5 of FIG. 2 during a buckling process. As shown in FIG. 5(*a*), the tongues 30 are inserted into the buckle insertion openings 2301 of the release button 2300. The lengths of the tongues 30 are chosen such that the latch ends 311 of the tongues 30 will contact and urge the ejectors 90 in a rearward direction corresponding to the direction of insertion of tongues 30. The release button 2300 is constantly urged downward or downward and forward by ejector biasing element, depicted by force A, or downward and forward, towards the substantially planar surface 87 of the frame 80.

FIG. 5(*b*) shows the state of the buckle assembly 10 when the ejectors 90 are pushed by the tongues 30 such that the ejector protrusions 91 of the ejectors are aligned with the frame ejector voids 86 and the ejector depressions 2203 of the bottom cover 2200 (not shown). At this point, it is understood that there is no force to oppose the force applied by spring 40 (force A). Therefore, the ejector 90 will translate directly downward with respect to the frame and the release button 2300 will be forced downward and forward to its original position along the path that is defined by the attachment openings 81 of the frame 80. The ejector protrusions 91 of the ejectors 90 will be inserted in both the frame ejector voids 86 and the ejector depressions 2203 of the bottom cover 2200 as shown in FIG. 5(*c*). In the preferred embodiment, the release button 2300 will only be closed upon insertion of both tongues 30. Specifically, in a preferred embodiment, both ejectors 90 must be simultaneously displaced in a rearward direction to allow for the downward translation of the release button 2300. In another embodiment, the buckle body may retain a first inserted ejector 90 until a second ejector 90 is inserted and the release button 2300 assumes the closed position. Other embodiments are possible. For example, the ejectors may be connected, thereby allowing the insertion of a first tongue to implement the method disclosed above.

While the ejector protrusions 91 are translating through frame ejector voids 86 and into ejector depressions 2203, the tongues 30 simultaneously engage fixed latches 84.

Specifically, the latch slots 312 of the tongues 30 are sized and located on the tongues 30 such that they are aligned with and will be placed over the fixed latches 84 of the frame 80. Accordingly, when the release button 2300 is moved to its initial position, the fixed latches 84 of the frame 80 will be disposed within the latch through slots 312 of the tongues 30, such that the tongues 30 cannot be removed from the release button 2300 and consequently from the buckle body 20. By this arrangement, buckling of the tongues 30 with the buckle body 20 is completed, as shown in FIG. 5(*c*).

Figure 6A:
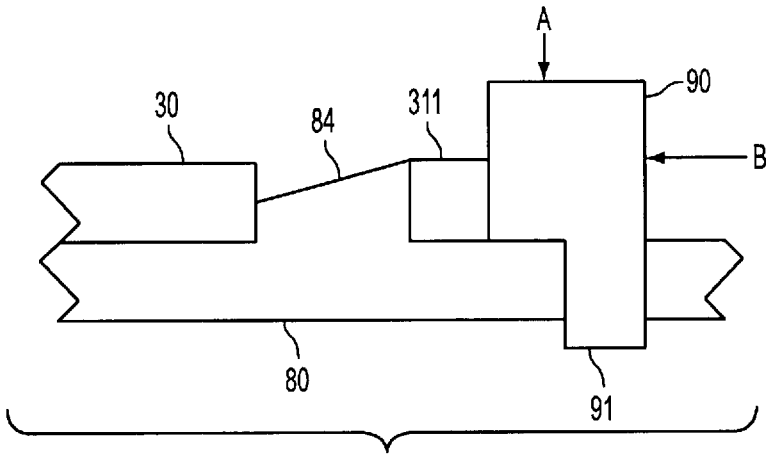
FIGS. 6(*a*) to 6(*c*) show a cross-section taken along 5—5 of FIG. 2 during an unbuckling process.
Figure 6B:
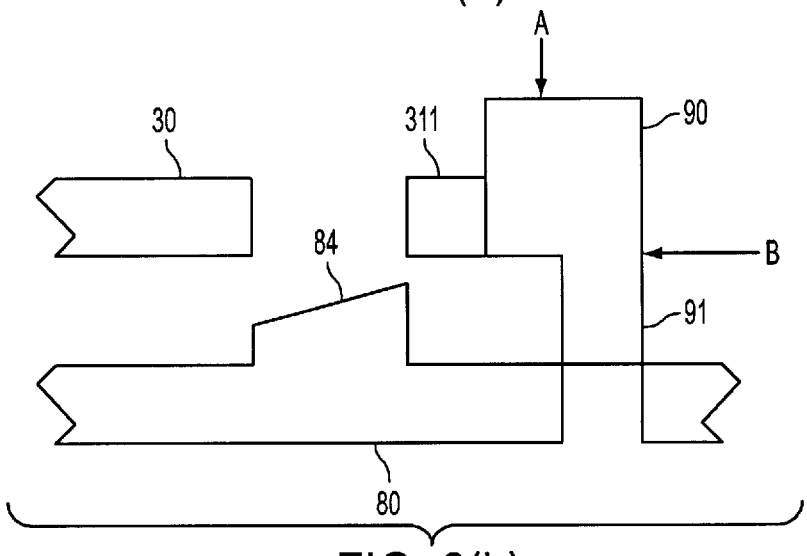
Figure 6C:
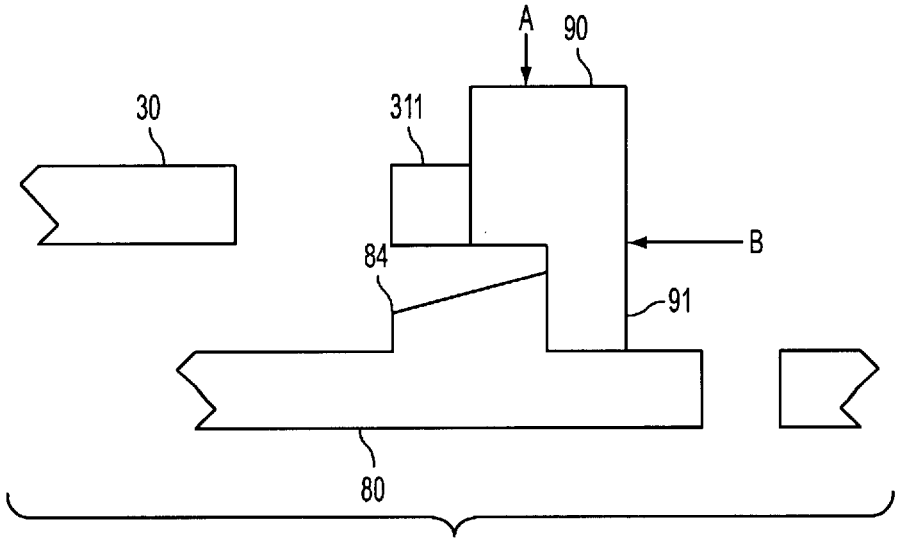

FIGS. 6(*a*) to 6(*c*) show a cross-section taken along 5—5 of FIG. 2 during an unbuckling process. In its closed state, as depicted in FIG. 6(*a*), spring 40 urges release button 2300 into frame 80. This force is represented as A in FIGS. 6(*a*) to 6(*c*). When a force C is applied to the release button 2300 (e.g., when release button 2300 is pushed with a predetermined force), release button 2300 moves backward and upward relative to the frame 80 in a path which is defined by the attachment openings 81 of the frame 80. The attachment openings are preferably sized, located, and configured such that the release button 2300 remains parallel to the substantially planar surface 87 of the frame 80 during its range of movement relative to the frame 80. As the release button 2300 is moved in a direction which corresponds to the direction of insertion of tongues 30 and away from the substantially planar surface 87 of the frame 80 (i.e., backward and upward), the ejectors 90 slide upward with release button 2300 fixed within ejector void 2305 by ejector retaining walls 2309. As ejector 90 is moving upwards with respect to the frame 80, ejectors 90 are not translating backwards with respect to the frame 80 because the protrusions 91 are engaged by ejector void 2305. The ejectors 90 withdraw first from the ejector depressions 2203 of the bottom cover 2200 (not shown) and second from the frame ejector voids 86. Once ejector 90 withdraws completely from ejector void 2305, the buckle is in a transitional position, as depicted in FIG. 6(*b*).

After the ejector protrusions 91 of the ejectors 90 are fully withdrawn from the ejector depressions 2203 of the bottom cover 220 and the frame ejector voids 86, the ejectors 90 are urged forward by force B (e.g., a force applied by the ejector biasing elements 95). Force B causes ejector 90 to translate in a direction opposite to the direction corresponding to the direction of insertion of the tongues 30 towards the front of the frame. In other words, force B ejects the tongues 30 at least partially from the release button. Once ejector 90 is pushed a predetermined distance, the buckle assemble is locked in the open configuration by ejectors 90 as depicted in FIG. 6(*c*). In one embodiment, the predetermined distance is the width of the ejector protrusion 91. In another embodiment, the predetermined distance is the distance from ejector void 2305 to fixed latch 84. Other distances may be used.

FIG. 6(*c*) shows the method of unbuckling the buckles in which the ejector 90 is translated to the fixed latch 84. By this arrangement, it is understood that the release button 2300 is locked in its rearward and upward position, and the ejector protrusions 91 of the ejectors 90 cannot return to the frame ejector voids 86 and/or the ejector depressions 2203 of the bottom cover 2300. The ejector protrusions 91 of the ejectors 90 contact the substantially planar surface 87 of the frame 80. Additionally, as per the above description, it is understood that due to the orientation of the springs 40, the release button 2300 is constantly urged downward and forward towards the substantially planar surface 87 of the frame 80.

It will be apparent to those skilled in the art that various modifications and variations can be made in the buckle assembly of the present invention without departing from the spirit or scope of the invention. Thus, it is intended that the present invention cover the modifications and variations of this invention provided they come within the scope of the appended claims and their equivalents.

What is claimed is:

1. A buckle assembly configured to receive a first and second tongue and selectively engaging the tongues with fixed latches, the buckle assembly comprising:

a frame comprising two fixed latches;

a release button comprising two pairs of ejector retaining walls, two ejector voids configured to receive a first and second ejector, and two buckle insertion openings configured to receive the first and second tongues, wherein the release button is configured to translate between an open position and a closed position in relation to the frame;

an urging member configured to urge the release button into the closed position; and a first and second ejector retained by the ejector retaining walls that selectively prevent the release button from translating into the closed position.

2. The assembly of claim 1, wherein the release button is configured such that the buckle insertion openings and the ejector voids are coplanar with each other.

3. The assembly of claim 1, wherein the two pairs of ejector retaining walls are configured to retain and allow the translation of a T-shaped ejector.

4. The assembly of claim 1, wherein the release button is configured such that the buckle insertion openings comprise a rectangular opening that extends through an entire cross-section of the release button.

5. The assembly of claim 1, wherein the first and second ejectors each comprise:

a planar surface;

a planar base extending substantially perpendicular to the planar surface; and a protrusion extending from a portion of a surface of the planar base.

6. The assembly of claim 5, wherein:

insertion of the first tongue into the first insertion opening causes the first ejector to translate away from the first insertion opening; and insertion of the second tongue into the second insertion opening causes the second ejector to translate away from the second insertion opening, such that when both the first and second ejectors translate to a predetermined position, the urging member urges the release button into the closed position.

7. The assembly of claim 5, wherein the protrusions give a portion of the ejector bases an increased cross-sectional height across a rearward portion of the ejectors, such that:

when the ejectors are in a rearward position, the ejectors do not oppose a translation of the release button into the closed configuration; and when the ejectors are in a forward position, the ejectors oppose the translation of the release button into the closed configuration.

8. The assembly of claim 1, wherein the frame additionally comprises:

at least two side wall portions extending substantially perpendicularly to the substantially planar surface of the frame, wherein the two side wall positions are configured to receive the release button.

9. The assembly of claim 8, wherein each of the side walls defines two attachment openings which each interface with an attachment extending from the release button, such that the attachment openings define a path by which the release button translates.

10. The assembly of claim 8, wherein the frame comprises a front end, a back end, and two side ends, wherein the two side ends are adjacent to two side walls that collectively define four uniformly shaped attachment openings each of said attachment openings comprising:

a first end; and a second end, wherein the first end is closer to the base of the frame and the front of the frame, and the second end is closer to the top of the frame and the back of the frame.

11. The assembly of claim 10, additionally comprising two tongues wherein the two fixed latches engage two latch receiving slots of the two tongues when the tongues are fully inserted into the buckle insertion openings.

12. The assembly of claim 1, further comprising an ejector urging member that translates the ejectors toward the buckle insertion openings when an ejector protrusion is withdrawn from an ejector void.

13. A method for positioning a buckle assembly into an open configuration, the buckle assembly comprising a release button and a frame having a fixed latch configured such that the release button translates in relation to the frame, the method comprising the acts:

receiving an externally applied force on the release button in a backwards direction in relation to the frame;

translating, in response to the externally applied force, the release button in a backwards and upwards direction in relation to the frame;

translating, in response to the translation of the release button, an ejector in an upward direction in relation to the frame until the ejector reaches a transition position; and translating, in response to the upward translation of the ejector to the transition position, the ejector in a forward direction such that the buckle assembly assumes an open configuration.

14. The method of claim 13, wherein the buckle assembly additionally comprises a tongue comprising a latch receiving slot, further comprising the act:

disengaging, in response to the translation of the release button, the latch receiving slot on the tongue from the fixed latch.

15. The method of claim 13, further wherein the translation path of the release button is determined by the shape of a set of attachment openings.

16. The method of claim 13, further comprising the act: the transition position is a position at which the ejector is able to translate in a forward direction.

17.The method of claim 13, wherein the transition position is a position at which an ejector protrusion is completely extracted from an ejector void on the frame.

18. A method for positioning a buckle assembly into a closed configuration, the buckle assembly comprising a release button having an ejector void and a frame having a fixed latch configured such that the release button translates in relation to the frame, the method comprising:

receiving a force applied to an ejector in a backwards direction;

translating said ejector, in response to said applied force, to a transition position; and translating, due to an internal force applied by an urging member, said release button to the closed position such that the fixed latch resides in the release button ejector void when the buckle assembly is in the closed configuration.

19. The method of claim 18, further comprising:

translating said ejector into a frame ejector void while said release button is translating to the buckled position.

20. The method of claim 18, wherein the transition position comprises a position at which an ejector protrusion is aligned with an ejector void.

21. The method of claim 18, wherein the buckle assembly comprises a tongue and the tongue applies the force to the ejector in the backwards direction.

* * * * *